United States Patent [19]

Hechtle

[11] 4,077,726

[45] Mar. 7, 1978

[54] GRIP-LOCK PEN

[75] Inventor: Emil Hechtle, Mountainside, N.J.

[73] Assignee: Radiant Pen Corporation, Kenilworth, N.J.

[21] Appl. No.: 696,505

[22] Filed: Jun. 16, 1976

[51] Int. Cl.[2] ..... B43K 7/00

[52] U.S. Cl. ..... 401/209; 401/34

[58] Field of Search ..... 401/209–217, 401/34

[56] References Cited

U.S. PATENT DOCUMENTS

| | | | |
|---|---|---|---|
| 3,077,184 | 2/1963 | Vogel | 401/34 |

FOREIGN PATENT DOCUMENTS

| | | | |
|---|---|---|---|
| 1,559,482 | 3/1969 | France | 401/216 |
| 530,283 | 7/1955 | Italy | 401/209 |
| 1,150,333 | 4/1969 | United Kingdom | 401/209 |

*Primary Examiner*—Stephen C. Pellegrino

*Attorney, Agent, or Firm*—Harry Ernest Rubens

[57] ABSTRACT

A pen body for a writing instrument, having a plastic barrel, and at the writing end, a collar that covers the end of the barrel, with the outside of the barrel and the inside surface of the collar containing complementary interlocking means for forming a grip-lock connection between the barrel and the collar. The barrel and the inside of the collar may be provided with camming surfaces to secure a ball-point cartridge to the barrel.

6 Claims, 3 Drawing Figures

GRIP-LOCK PEN

This invention relates generally to writing instruments and specifically of the ball-point type.

It is a frequent occurrence for the writing pressures generated, to cause the metal tip containing the ball, to press against the feathered edge of the barrel, causing it to crack.

In the pencil-shaped, non-retractable type known as a stick pen, such as is shown in U.S. Pat. No. 3,418,057, the entire assembly may be made so inexpensively, that the pen is discarded when the ink cartridge is depleted.

The barrel is made of low cost general purpose styrene which may not take the tension developed in the writing end when extra pressures are developed, as for example in making copies, or in causing a sticky ball to roll. The split end of the barrel effectively destroys its function in holding the cartridge.

Another economic problem arises in reaching minimum manufacturing costs, based on the shape of the metal part which holds the ball. It is usually arrow-shaped, to permit a wedge fit into the end of the barrel, stopping automatically at the shoulder formed by the arrowshape. These metal parts are usually made on a screw machine at a cost greater than standard cartridges which are not arrow-shaped as found in retractable pens.

Figure 1:
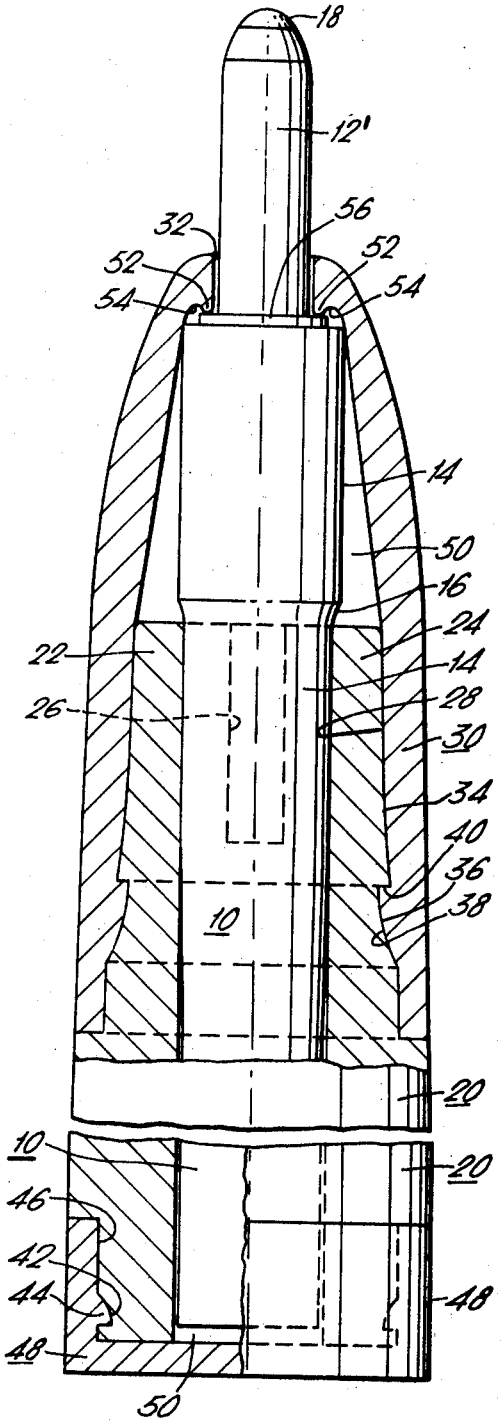
Figure 2:
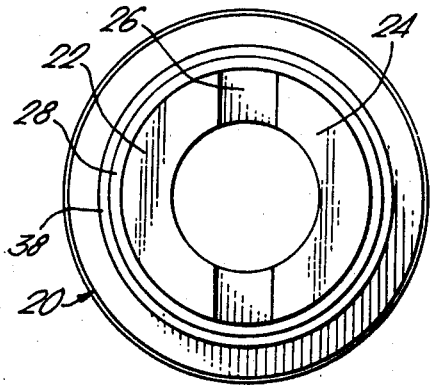
Figure 3:
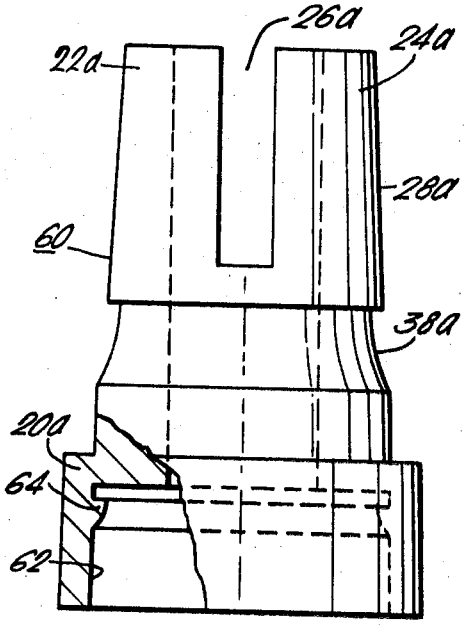

These and other objects are achieved, and the new results, obtained, as will be apparent from a consideration of the following description, claims, and drawing, in which:

FIG. 1. is a longitudinally, partially sectioned and shortened view of the proposed writing instrument;

FIG. 2. is an end view of the plastic barrel of the writing instrument;

FIG. 3. is a longitudinal view of a special adaptor for increasing the cartridge capacity of the writing instrument.

With reference to FIG. 1 of the drawing, a standard ball-point cartridge 10 is shown, positioned in a hollow pen barrel 20. Over the writing end of the barrel, and encircling collar 30 is cammed and grip-locked thereto, as will be hereinafter described.

As a result of the embracing collar, the writing pressure exerted by the cartridge, is transmitted by compression through the barrel and converted into a tensional force in the collar.

Thus the barrel may be made of low cost styrene of the general purpose type which is brittle and which is easily broken by a tensional force stretching the barrel wall, while the collar, being relatively small, may be made of more expensive high-strength plastic such as Delrin or Celcon capable of taking a high tensional force. The use of the collar thus enables the continued use of the low cost plastic without the danger of cracking under high writing pressures.

The cartridge 10, terminates at its writing end in a metal insert 12, which is force-fitted into the open end of the ink tube 14, enlarging it as at 16. The ink is transmitted through the neck 12' of the metal insert to the seated and revolving ball 18.

The barrel 20 terminates at its writing end in hollow projections 22 and 24 spaced apart by the gap 26 which serves as a passageway venting the air in the barrel. The outer surface of each projection is tapererd as at 28 to form a camming surface for the collar 30 applied thereover. The collar is apertured to receive the neck 12' of the metal insert, allowing the ball 18 to project a suitable distance outside the collar, when installed.

The inside wall of the collar is similarly tapered as at 34 to correspond to the taper 28 of the projections on the barrel. This permits the collar to cam the tapered projections and compress them slightly about the cartridge preventing inward movement.

Peripherally positioned on the inner surface of the collar a camming bead 36 is formed to resiliently seat itself into the similarly shaped groove 38 on the outer surface of the barrel. This will lock the the collar to the barrel when seated thereon. The bead and groove are shouldered as at 40 to lock the two parts securely.

At the opposite end of the barrel, a similar groove 42 is located on the rim to securely lock with a bead 44 of a connecting closure plug 50 when force-fitted to rim 46 of the barrel. The closure plug may be coded to the ink color of the cartridge in the barrel.

If the cartridge used is the standard capillary type, the inner chamber of the barrel should be vented to the atmosphere to insure proper ink flow. This is accomplished by the passageway 26 between the projections leading to the upper chamber 50. Projections 52 formed on the inner wall of the collar at 54, holds the end of the insert at 56, away from the opening 32 in the collar through which the neck 12' of the cartridge projects, allowing for the free flow of air within the barrel to the atmosphere.

In FIG. 3 I have illustrated an adaptor 20a for adding another cartridge to the writing instrument forming if desired a two-color pen. The adaptor is provided with projections **22*a* and 24*a*, spaced apart as at 26*a*, with camming surfaces 28*a* and groove 38*a*, all corresponding to the end of the barrel as shown in FIG. 1**.

At the other end of the adaptor **20*a*, a rim 62 is formed to fit over the rim 46 of the lower end of barrel 20, in place of the closure plug 48. If the adaptor is made of resilient plastic like that of collar 30, the peripheral bead 64 may be provided to seat itself in groove 42 of barrel 20. However the adapter 20*a* may also be made of styrene, in which case the bead should be omitted and the adapter force-fitted or otherwise secured to the body 20**.

The collar is a small portion of the barrel, the distortion in the drawing shows the parts out of proportion with respect to their length. For example in an actual pen having a barrel length of five and one-half inches, the barrel diameter being 0.310", and the wall thickness 0.040", the actual length of the collar is 0.610", while the adaptor is 0.700". The dimensions may be varied.

I have thus described my invention, but it should be understood that that it is not confined to the particular forms shown or described uses, the same being illustrative only and the invention may be carried out in other ways without departing from the spirit of my invention, and I claim the right to employ all equivalent instrumentalities coming within the scope of the appended claims and by means of which objects of my invention are obtained and new results accomplished as the particular embodiments shown and described are only some of the many that can be employed to obtain these objects and accomplish these results.

I claim:

1. A pen body for substantially enclosing a completely assembled, self contained ball-point cartridge to form a writing instrument, comprising a plastic barrel, the end of the barrel provided with means for preventing the cartrige from inward movement with respect to the barrel during the writing position, and a collar tightly compressing the outside of the end of the barrel, said barrel and collar means having an opening through which the writing tip of said ball-point cartridge extends, said collar means enclosing and having complementary interlocking means for securing the collar to the barrel preventing expansion of the barrel end, and provided with means for retaining the cartridge writing tip of said ball-point in outward position.

2. The pen body of claim 1, wherein the outside surface of the barrel end and the contacting inside surface of the collar are tapered to tightly compress the barrel end.

3. The pen body of claim 1, wherein the inside of the barrel is provided with a standard ball-point pen cartridge, consisting of a tubular reservoir, a metal insert writing tip, containing a ball, and is secured between the barrel end and the collar.

4. The pen body of claim 1, wherein the barrel is provided with a longitudinally slotted air vent, between the collar and the barrel to allow air communication through the center of the collar

5. The pen body of claim 1, wherein the collar is made of more resilient plastic material than the plastic barrel of styrene.

6. The pen body of claim 1, wherein the end of the barrel, opposite its writing end, is attached to an adaptor having a compressible tapered end, said adaptor having a collar to compress the tapered end, said collar and adaptor being formed with interlocking means for securing a second cartridge to the pen body, in writing position.

* * * * *